US007971962B2

(12) United States Patent
Murata

(10) Patent No.: US 7,971,962 B2
(45) Date of Patent: Jul. 5, 2011

(54) COLLECTIVE TRANSFER INKJET NOZZLE PLATE AND METHOD OF PRODUCING THE SAME

(75) Inventor: Kazuhiro Murata, Tsukuba (JP)

(73) Assignee: National Institute of Advanced Industrial Science and Technology, Tokyo (JP)

( * ) Notice: Subject to any disclaimer, the term of this patent is extended or adjusted under 35 U.S.C. 154(b) by 950 days.

(21) Appl. No.: 11/883,232

(22) PCT Filed: Dec. 9, 2005

(86) PCT No.: PCT/JP2005/022613

§ 371 (c)(1),
(2), (4) Date: Sep. 25, 2007

(87) PCT Pub. No.: WO2006/080145

PCT Pub. Date: Aug. 3, 2006

(65) Prior Publication Data

US 2008/0198199 A1 Aug. 21, 2008

(30) Foreign Application Priority Data

Jan. 31, 2005 (JP) ..... 2005-024161

(51) Int. Cl.
*B41J 2/14* (2006.01)
*B41J 2/16* (2006.01)

(52) U.S. Cl. ..... 347/47; 347/67

(58) Field of Classification Search ..... 347/47, 347/84–86, 45, 65–71; 29/890.1
See application file for complete search history.

(56) References Cited

U.S. PATENT DOCUMENTS 5,548,894 A * 8/1996 Muto ..... 29/890.1
6,089,698 A * 7/2000 Temple et al. ..... 347/47
2002/0167101 A1 11/2002 Tochimoto et al.

FOREIGN PATENT DOCUMENTS

EP 0 569 156 A2 11/1993
EP 1 477 230 A1 11/2004

(Continued)

OTHER PUBLICATIONS

Extended European Search Report issued on Mar. 3, 2010 in corresponding European patent application No. 05814722.4-2304/1844935 PCT/JP2005022613.

*Primary Examiner* — Thinh H Nguyen
(74) *Attorney, Agent, or Firm* — Birch, Stewart, Kolasch & Birch, LLP

(57) ABSTRACT

There provides a nozzle plate having fine nozzle holes capable of transferring a pattern collectively, and a method of producing the same. Further, there provides a method of forming fine nozzle holes in a required shape, at a required position on a substrate, and an inkjet nozzle plate obtained by the method. Moreover, there provides a collective transfer inkjet nozzle plate can have a high imaging efficiency, and can reduce the cost by simplifying a nozzle controller; and a method of producing the same.
Fine nozzle holes in a plate of a setting material are formed by: forming three-dimensional structures on a substrate in accordance with a fine inkjet process based on data in a computer, coating a setting material in a portion other than portions where the three-dimensional structures are formed, and then hardening and removing the setting material.

14 Claims, 5 Drawing Sheets

FOREIGN PATENT DOCUMENTS

| | | | |
|---|---|---|---|
| EP | 1 498 277 | A1 | 1/2006 |
| JP | 63-11353 | A | 1/1988 |
| JP | 1-264854 | A | 10/1989 |
| JP | 10-24549 | A | 1/1998 |
| JP | 2001-212927 | A | 8/2001 |
| JP | 2002-137381 | A | 5/2002 |
| JP | 2003-313270 | A | 11/2003 |
| WO | WO 99/01284 | A1 | 1/1999 |

* cited by examiner

COLLECTIVE TRANSFER INKJET NOZZLE PLATE AND METHOD OF PRODUCING THE SAME

TECHNICAL FIELD

The present invention relates to a collective transfer inkjet for forming an image pattern collectively, and a collective transfer inkjet nozzle plate which can be used therefor, as well as a method of producing the same. Further, the present invention relates to formation of three-dimensional structures using a fine inkjet process, and a method of producing a collective transfer inkjet nozzle plate in which fine nozzle holes are formed by contours of the three-dimensional structures.

BACKGROUND ART

A pattern imaging of an inkjet is conducted by forming images with scanning either or both of the nozzle and the substrate. According to an advantageous aspect of this method, data in a computer for controlling the nozzle and the substrate allows the pattern to be appropriately and freely changed. However, as a problem, throughput of the above method is inferior to imaging technologies such as a light exposure technique to form images by using a printing plate and screen printing.

For the purpose of improving such throughput, attempts have been made to place inkjet nozzles in a desired pattern. However, conventional inkjet nozzles including piezo types have a complicated ejection mechanism, and therefore it is difficult to freely design and arrange the position of the nozzles (particularly in a fine alignment).

In addition, formation of a nozzle hole having a fine diameter is difficult, per se. As technology for the hole forming processes, there exist laser processing, light exposure technique, RIE (reactive ion etching), discharge processing, and the like can be cited, but it is difficult to form fine holes in accordance with the above-described processes.

DISCLOSURE OF INVENTION

Problems that the Invention is to Solve

The present invention contemplates providing a nozzle plate having fine nozzle holes which can transfer a pattern collectively (in the present invention, "transfer" means imaging a pattern or the like, and the meaning includes formation of a duplicated image of a specific pattern), and providing a method of producing the same. Further, the present invention contemplates providing a method of forming a fine nozzle holes at required positions and in required shapes in a substrate (nozzle plate), and providing an inkjet nozzle plate obtained by the method.

Moreover, the present invention contemplates providing a collective transfer inkjet nozzle plate which can have high imaging efficiency to form a prescribed pattern, and can reduce the cost by simplifying a nozzle controller; and a method of producing the same.

Means to Solve the Problems

The above objects can be attained by the following means.

(1) A method of producing a collective transfer inkjet nozzle plate, comprising:

forming three-dimensional structures arranged on a substrate in accordance with a fine inkjet process according to the data in a computer, coating a setting material in a portion other than portions where the three-dimensional structures are formed, then hardening the setting material, and then removing a plate of said hardened setting material to form fine nozzle holes therein.

(2) The method of producing a collective transfer inkjet nozzle plate according to item (1), wherein the setting material is a metal material, a metal oxide material, a resin, or a mixed material thereof.

(3) The method of producing a collective transfer inkjet nozzle plate according to item (1) or (2), wherein the setting material is an ultraviolet-ray hardening resin.

(4) The method of producing a collective transfer inkjet nozzle plate according to any one of items (1) to (3), wherein an inner diameter of the fine nozzle holes is in the range of from 0.1 μm to 100 μm.

(5) The method of producing a collective transfer inkjet nozzle plate according to any one of items (1) to (4), wherein the fine nozzle holes are aligned in a prescribed pattern by setting the data in the computer.

(6) The method of producing a collective transfer inkjet nozzle plate according to any one of items (1) to (5), wherein the fine inkjet process comprises, to form the three-dimensional structures: flying and landing fine droplets onto the substrate by a focused electric field, and drying and solidifying the fine droplets to be stacked up.

(7) A collective transfer inkjet nozzle plate, comprising fine nozzle holes in the nozzle plate formed by contours of three-dimensional structures, in which the three-dimensional structures are formed on a substrate in accordance with a fine inkjet process on the basis of data in a computer.

(8) The collective transfer inkjet nozzle plate according to item (7), wherein an inner diameter of the fine nozzle holes is in the range of from 0.1 μm to 100 μm.

(9) The collective transfer inkjet nozzle plate according to item (7) or (8), wherein the fine nozzle holes are aligned in a prescribed pattern by setting the data in the computer.

(10) The collective transfer inkjet nozzle plate according to any one of items (7) to (9), wherein the nozzle plate is made of a metal material, a metal oxide material, a resin, or a mixed material thereof.

(11) A collective transfer inkjet, mounting at least one said collective transfer inkjet nozzle plate according to any one of items (7) to (10).

EFFECTS OF THE INVENTION

According to a method of producing a collective transfer inkjet nozzle plate of the present invention, by utilizing its function as a patterning plate of the nozzle plate, a required pattern image can be drawn efficiently (shortening of the time, reduction in the loss of ink materials, and the like). Further, according to the method of producing a collective transfer inkjet nozzle plate of the present invention, nozzle control (drop on demand treatment) for forming a pattern can be omitted; thereby a control device can be simplified, and thus a structure of the inkjet can be facilitated and the cost can be reduced.

Moreover, according to the method of producing a collective transfer inkjet nozzle plate of the present invention, degree of freedom of designing a nozzle holes alignment can be improved in virtue of the nozzle forming process, and a desired pattern of fine nozzle holes can be formed and aligned (position, shape, and the like).

DESCRIPTION OF NUMERALS

Figure 1:
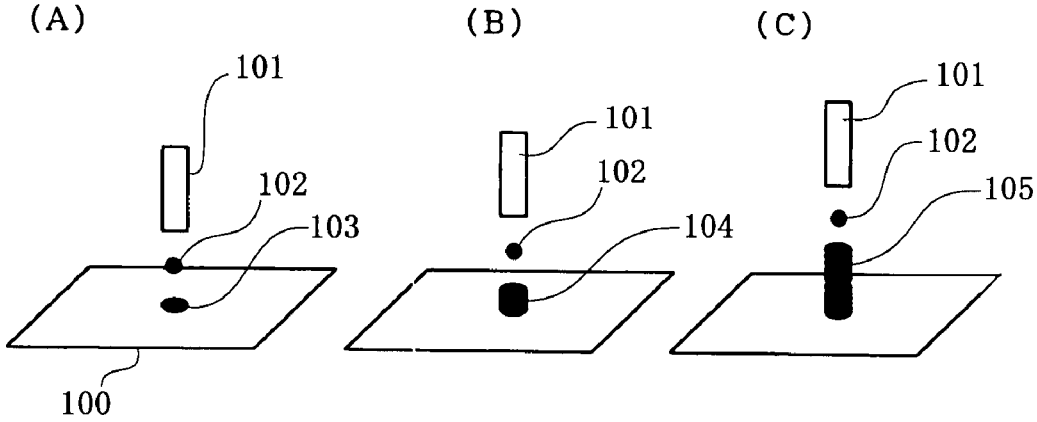
[FIG. 1] It is a schematic drawing to show steps of a beginning stage (A), a middle stage (B), and a later stage (C), for producing a fine three-dimensional structure in the production method of the present invention.

1 Nozzle (Needle-shaped fluid discharging body)
2 Metal electrode wire
3 Fluid (Solution)
4 Shield rubber
5 Nozzle clamp
6 Holder
7 Pressure regulator
8 Pressure tube
9 Computer
10 Prescribed waveform generation device
11 High-voltage amplifier
12 Lead
13 Substrate
14 Substrate holder
100 Substrate
101 Nozzle (Needle-shaped fluid discharging body)
102 Fine droplet (droplet having fine diameter)
103 Solidified liquid droplet
104 Structure
105 Three-dimensional structure

BEST MODE FOR CARRYING OUT THE INVENTION

A method of producing a collective transfer inkjet nozzle plate of the present invention is characterized in that three-dimensional structures are formed on a substrate in accordance with a fine inkjet process and nozzle holes are formed by contours of the three-dimensional structures. In the following, the present invention is described in detail.

In the fine inkjet process, an electric field is used so that a fine fluid flies onto a substrate and the fine fluid solidifies at a high speed due to the quick drying properties of the fine droplets, and thus a three-dimensional structure is formed. It is preferable for the fine droplet used for the formation of the three-dimensional structure to have a fine droplet diameter of 15 μm or less, it is more preferable of 5 μm or less, it is still more preferable of 3 μm or less, and it is particularly preferable of 1 μm or less.

It is preferable for the structure formed of fine droplets to have a cross-sectional diameter (diameter of a short side in a cross section or at the bottom) of 20 μm or less, it is more preferable of 15 μm or less, it is still more preferable of 5 μm or less, it is further more preferable of 3 μm or less, and it is particularly preferable of 1 μm or less (in the present invention, the structure formed of fine droplets is referred to as fine bump or fine three-dimensional structure, or simply referred to as bump or three-dimensional structure). Accordingly, a preferable nozzle inner diameter of the nozzle hole, formed through molded from it, can be made the same as the cross-sectional diameter of the three-dimensional structure (in the present invention, unless otherwise particularly specified, "nozzle inner diameter" is defined as the diameter of a nozzle hole in an opening or in a cross section, and as a circle-equivalent diameter when the area of the opening or the cross section is regarded as that of a circle irrelevant to the shape thereof. In addition, this may also be referred to as opening diameter).

Further, according to a fine inkjet process can be used in the present invention, the interval between three-dimensional structures (distance between the closest wall surfaces of two adjacent three-dimensional structures) can be made larger or smaller depending on a required imaging pattern. Specifically, the interval can be a narrow pitch of 10 μm or less (e.g., approximately 5 μm) in order to meet the demand of miniaturization. The interval of the nozzle holes to be molded is the same as the interval of the three-dimensional structures, and thus the demand of reduction in the pitch can be met. In addition, nozzle holes created according to the production method of the present invention are particularly referred to as fine nozzle holes, in the case where the nozzle holes are distinguished from those obtained in the conventional technique.

The three-dimensional structure formed in a method of producing a collective transfer inkjet nozzle plate of the present invention is such that grows not two-dimensionally but three-dimensionally in the direction of height, and the three-dimensional structure is formed preferably in the shape in which height is equal to or more than the cross-sectional diameter of its base portion; in other words, the three-dimensional structure has an aspect ratio of 1 or more, preferably has an aspect ratio of 2 or more, more preferably has an aspect ratio of 3 or more, and particularly preferably has an aspect ratio of 5 or more. There is not an upper limit to the height or the aspect ratio of the three-dimensional structure, and the three-dimensional structure can be grown to be of an aspect ratio of 100 or more, or 200 or more, if the three-dimensional structure can stand by itself even if it is slightly bent. The height of the three-dimensional structures can be appropriately adjusted in accordance with the depth of the nozzle holes, and it is preferable for the height to be 5 μm to 50 μm, and it is more preferable for it to be 10 μm to 30 μm. Accordingly, the aspect ratio of the nozzle holes (value gained by dividing the depth of the nozzle holes by the nozzle inner diameter) can be set in the same range as the aspect ratio of the three-dimensional structures. In addition, the depth of the nozzle holes (this may be referred to as the thickness of the nozzle plate) can also be made the same depth as that of the three-dimensional structures.

The form of the three-dimensional structure is not limited and can be determined depending on a desired form of the nozzle hole and may be, for example, a column, an elliptical column, a conical (truncated conical) form, a form of which the projected shape from above is linear, or a box.

In the method of producing a collective transfer inkjet nozzle plate of the present invention, three-dimensional structures are formed by ejecting fine droplets in accordance with a fine inkjet process. Such fine droplets are evaporated extremely quickly by the influence of surface tension and the magnitude of a specific surface area. Hence, by controlling the drying and solidifying of the droplet (in the present invention, unless otherwise specified, the terms of drying and solidifying means that the liquid drops are evaporated and dried, thereby being increased in viscosity at least to a level such that the droplets can be stacked up), impact energy, focusing of electric filed, and the like at appropriate levels, it is possible to form a three-dimensional structure having height.

Further, in a fine inkjet process, stress toward the tip of a needle-shaped fluid discharging body (hereinafter also referred to as "nozzle") is continuously applied to the top of a structure formed by droplets that have been previously landed to a substrate (hereinafter also referred to as "previously landed droplets") and that have been solidified, in virtue of an effect of an electric field applied to an ultra-fine inkjet. Accordingly, once a structure starts growing, an electric field can be focused on the top of the structure. For this reason, an ejected droplet can be reliably and accurately landed on the top of the structure formed by the droplets having attached in advance.

Furthermore, the structure can be grown in the direction of the nozzle while it is always pulled by the above-mentioned effect produced by the electric field, and hence even if the structure has a high aspect ratio the structure can be formed without falling. These effects can efficiently promote the growth of a three-dimensional structure. In addition, the electric field may not be applied between the liquid ejecting nozzle and the substrate, and instead, an electric field generated by an electrode provided in a location different from the nozzle may be used. Further, a driving voltage, a driving voltage waveform, a driving frequency, or the like may be changed in accordance with the growth of the structure.

This process is schematically shown in FIG. 1. (A) shows a beginning stage of forming a three-dimensional structure. A fine droplet 102 ejected toward a substrate 100 from a nozzle 101 lands on the substrate 100, and being brought into the state of a solidified liquid droplet (substance such that the liquid drop is solidified) 103. (B) shows a middle stage in which the droplets continuously land and solidify and stack to form a structure 104. (C) shows a later stage in which the ultra-fine droplets land concentrically to the top of the structure having stacked on the substrate in the above-mentioned manner to form a three-dimensional structure 105.

According to the method of producing a collective transfer inkjet nozzle plate of the present invention, it is preferable for a liquid material ejected through a fine inkjet of forming the three-dimensional structure to have a high permittivity and a high conductivity. For example, a liquid material preferably has a dielectric constant of 1 or more, more preferably 2 to 10, besides it preferably has conductivity of $10^{-5}$ S/m or more. It is preferable that fluid material easily generating focus of an electric field is used for the method. It is preferable that a liquid material and a substance such that the liquid fluid material is solidified have a dielectric constant higher than the material of the substrate. An electric field is generated on the surface of the substrate by voltage applied to the nozzle. In this case, when a droplet lands and attaches on the substrate, the density of an electric line of force passing through the liquid becomes higher than that in a portion of the substrate where the droplet does not attach. This state is referred to as a state where focusing of an electric field is developed. Then, once a structure starts to be generated, at the top of the structure, there occurs polarization due to the electric field or focusing of the electric line of force because of its shape. The droplet flies along the electric line of force and the droplet is attracted to a portion where the density of the electric line of force is the highest. That is, the droplet is attracted to the top of the pre-formed structure. For this reason, a subsequently/flying droplet stacks selectively and accurately on the top of the structure.

A substrate which can allow the formation of the three-dimensional structures and can appropriate be of a template for molding a setting material is preferable. The substrate may be of an insulator or a conductor, and may be of, e.g., a metal, glass, and silicon substrates. Though the thickness of the substrate is not particularly limited, 0.01 mm to 10 mm is preferable.

In order to form three-dimensional structures, as liquid materials ejected from a fine inkjet, a liquid material containing metal particulates (for example, metal particulates pastes), polymer solutions, such as ethanol solutions of polyvinyl phenol (for example, Malcalinker (trade name)), sol-gel solutions of ceramics, solutions of low molecular substances, such as oligothiophene, photocuring resins, thermosetting resins and micro-bead fluids can be used and one type from among these solutions may be used, or a number of solutions may be combined for use. From among these, it is preferable to use a liquid material containing ultrafine metal particles as the conductive material. Examples of the metal species in the liquid materials containing the metal particulates are almost all kinds of metals or oxides thereof. A preferable metal is a metal having electroconductivity such as gold: silver, copper, platinum, palladium, tungsten, tantalum, bismuth, lead, tin, indium, zinc, titanium, nickel, iron, cobalt, aluminum, or the like. A more preferable metal is gold, silver, copper, platinum, or palladium. A particularly preferable metal is gold or silver. A single metal may be used, or an alloy made of two or more metals may be used. The metal particulates preferably have a particle diameter from 1 to 100 nm, more preferably from 1 to 20 nm, particularly preferably from 2 to 10 nm.

In addition, in the method of producing a collective transfer inkjet nozzle plate of the present invention, heat treatment may be carried out after the formation of the three-dimensional structure (in the present invention, heat treatment includes sintering treatment unless otherwise particularly specified). An appropriate temperature can be set for heat treatment on the basis of the properties, for example at the melting point of the used metal or alloy. It is preferable for the temperature for heat treatment to be 50° C. to 300° C., and it is more preferable for it to be 100° C. to 250° C. Heat treatment may be carried out according to an ordinary method, and can be carried out though laser irradiation, infrared ray beam irradiation, or using a gas or a vapor at a high temperature, for example. As the atmosphere at the time of heat treatment, air, an inert gas atmosphere, a reduced pressure atmosphere, an atmosphere of a reducing gas, such as hydrogen, and the like can be used, and an atmosphere of a reducing gas is preferable, in order to prevent oxidation of the ultrafine metal particles.

In the method of producing a collective transfer inkjet nozzle plate of the present invention, though whatever a number of three-dimensional structures may be provided on a substrate, 1 to 100,000 is preferable and 10 to 1,000 is more preferable, and these may be arranged in any manner. Though the size of the substrate is not particularly limited, it is preferable for the diameter of a circle having the same area as the probe card as found through calculation to be no greater than approximately 250 mm.

In the method of producing a collective transfer inkjet nozzle plate of the present invention, the pitch of the three-dimensional structures can be made large or small. Therefore, a design is possible in accordance with a targeted drawing pattern, and a group of three-dimensional structures can be provided with high precision and incomparably high density, particularly in accordance with the demands of miniaturization. In the case where the nozzle holes are provided with high density, 1,000 nozzle holes, for example, can be provided per $mm^2$, and 10,000 nozzle holes can also be provided per $mm^2$. Accordingly, nozzle holes in the nozzle plate molded from this can be provided with the same high density, and thus, the arrangement of nozzle holes with high density and a small pitch, to an extent which is difficult according to the prior art, becomes possible.

A solvent of a liquid material used in the present invention may be water, tetradecane, toluene, alcohol or the like. A concentration of metal particulates in the solvent is preferably higher, and is preferably 40% by mass or more, more preferably 55% by mass or more. In this regard, the concentration can be decided, considering the fluidity, the vapor pressure, the boiling point and other properties of the solvent and conditions for forming a three-dimensional structure, for example, the temperature of the substrate and/or the atmosphere, the vapor pressure, and the amount of the discharged liquid droplets for the following reason: for example, in the case that the boiling point of the solvent is low, the solvent component evaporates when the liquid droplets fly or land; accordingly, in many cases, the concentration at the time of the landing on a substrate is remarkably different from the discharged concentration of the particulates.

In order to form the three-dimensional structure, it is preferable that the viscosity of the liquid material used in the present invention is high. It is, however, necessary that the viscosity is within such a range that the paste can be inkjetted. Thus, it is necessary to decide the viscosity with attention. The viscosity also depends on the kind of the paste. In the case of, for example, a silver nano past has a viscosity, preferably from 3 to 50 centipoises (more preferably from 8 to 30 centipoises).

Though there are no particular limitations in terms of the boiling point of the solvent used for the liquid material as long as drying and solidification are appropriate, it is preferable for it to be of 300° C. or less, it is more preferable for it to be of 250° C. or less, and it is; particularly preferable for it to be of 220° C. or less. Further, materials having a considerably high drying speed and having its viscosity changed by a large amount by drying can be preferably used as for forming the three-dimensional structure. Time required for the droplet to be dried and solidified, the flying speed of the droplet, and the vapor pressure of solvent in the atmosphere can be set as appropriate according to the solution to be a material forming the three-dimensional structure. As for preferable conditions, a preferable time for the droplet to be dried and solidified is 2 seconds or less, more preferably 1 second or less, and particularly preferably 0.1 second or less; a preferable flying speed is 4 m/sec or more, more preferably 6 m/sec or more, and particularly preferably 10 m/sec or more. A practical flying speed is 20 m/sec or less, although there is no upper limit. A preferable atmospheric pressure is less than a saturated vapor pressure of a solvent.

Since the production method of the present invention utilizes optimal evaporation of droplets, the sizes of the discharged droplet can be reduced, and the three-dimensional structure can be formed with a cross-sectional diameter smaller than the diameter of the droplet at ejected. In other words, according to the production method of the present invention, the fine three-dimensional structure can be formal, even which is thought to be difficult in the conventional art, and a cross-sectional diameter of the fine three-dimensional structure can be freely controlled. Therefore, it is possible to control a cross-sectional diameter as appropriate not only by adjusting the diameter of a nozzle or the concentration of a solid component in the ejection fluid but also by using the evaporation of the ejected droplets. This control can be also determined in consideration of working efficiency such as time required to form the three-dimensional structure in addition to a required cross-sectional diameter. Moreover, for example, the following method can be employed as another control method. That is, an applied voltage is increased to increase the amount of liquid for ejection, and thereby dissolve a stacked substance that has been previously dried, solidified, and stacked. Then the applied voltage is lowered to decrease the amount of liquid to thereby again promote stacking and growth of droplets in the direction of height. In this manner, by changing the applied voltage to repetitively increase or decrease the amount of liquid, it is possible to grow the three-dimensional structure while securing a required cross-sectional diameter.

A range of a cross-sectional diameter, in the case of increasing a cross-sectional diameter, with taking the working efficiency into consideration, can preferably be made in 20 times or less of the inside diameter of the tip of the nozzle, more preferably 5 times or less thereof. In the case of decreasing the cross-sectional diameter, the cross-sectional diameter can preferably be made in 1/10 or more times of the inside diameter of the tip of the nozzle, more preferably 1/5 or more times, and particularly preferably 1/2 or more times thereof.

In the process of stacking and building the solidified substance of droplets on the substrate in virtue of the evaporation of the ejected droplets, by controlling a temperature of a surface of the substrate, the volatile property of the liquid component of the droplet can be promoted when and after the droplet landing on the substrate, whereby the viscosity of the landing droplet can be increased within a desired period of time. Accordingly, for example, even under conditions where the droplet is usually hard to be stacked on because the amount of liquid of the droplet is too large, heating of the surface of the substrate makes it possible to accelerate the drying and solidifying of the droplet, and to stack and build the substance of the droplets, and hence formation of a three-dimensional structure can be realized. Moreover, the increasing of the speed of drying and solidifying the droplet can make the interval of ejecting droplets shorter and can improve working efficiency also.

A controlling means of the substrate temperature is not particularly limited, and a Peltier element, an electric heater, an infrared heater, a heater using fluid such as an oil heater, a silicon rubber heater, or a thermistor can be used. Moreover, the substrate temperature can be controlled as appropriate according to the volatile property of liquid of material or a droplet to be used, preferably from 20 to 150° C., more preferably from 25° C. to 70° C., particularly preferably from 30° C. to 50° C. The substrate temperature is preferably set at a temperature higher than that of the droplet at landing, preferably higher by approximately 5° C. or more than that of the landing droplet, more preferably higher by approximately 10° C. or more than that of the landing droplet.

As for the amount of evaporation of the droplet, it is also thought to control the amount of evaporation of the droplet by the atmospheric temperature or the vapor pressure of solvent in the atmosphere, but according to the production method of the present invention, a three-dimensional structure can be manufactured by an industrially preferable method of controlling the temperature of the surface of the substrate without using a complicated apparatus.

Figure 2:
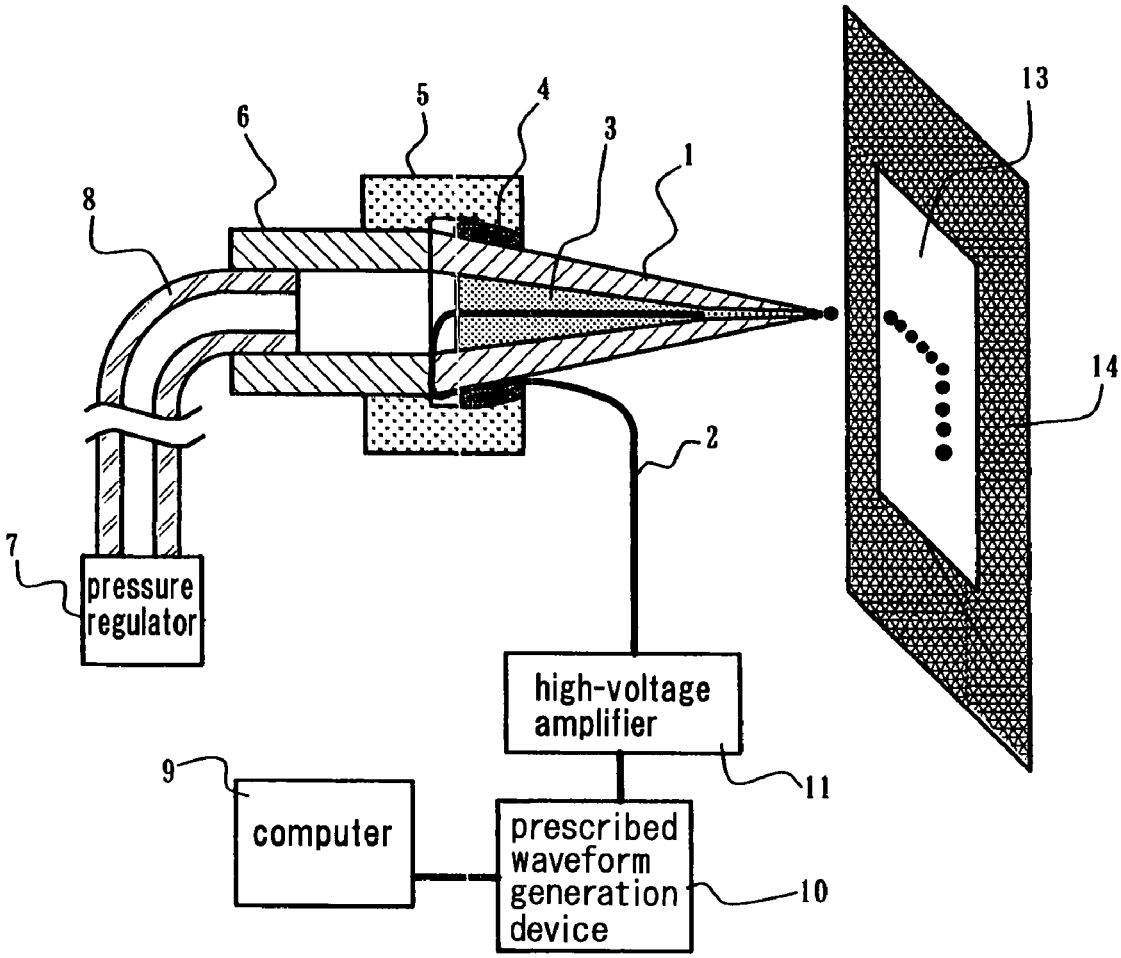
[FIG. 2] It is an explanatory drawing of one embodiment of a fine inkjet apparatus which is used in the production method of the present invention.

FIG. 2 is a drawing, partly in a cross section, of one embodiment of a fine inkjet apparatus preferably applicable for implementing the present invention (in the present invention, a method for focusing an electric field so that a fine droplet flies and adheres to a substrate, stacking the droplet through drying and solidification, and thus forming a fine bump is referred to as fine inkjet method, and the droplet ejecting apparatus is referred to as fine inkjet apparatus). In order to realize the size of a fine droplet, a flow passage having a low conductance is preferably arranged near the nozzle 1, or the nozzle 1 itself preferably has a low conductance. Therefore, in the case of a single nozzle, a fine capillary tube made of glass is preferable, and a conductive substance coated with an insulating material is also possible. The reasons why the nozzle 1 preferably consists of glass are as follows: a nozzle having a diameter of about several μm can be easily formed; the nozzle being tapered, an electric field is easily focused on the distal end of the nozzle, an unnecessary solution moves upward by surface tension, and it is not retained at the nozzle end, that is, clogging of the nozzle is not caused; and the nozzle has approximate flexibility. Furthermore, the low conductance is preferably regarded as 10 to 10 $m^3/s$ or less. Although the shape to be a low conductance is not limited to the following shapes, as the shape, for example, a cylindrical flow passage having a small inner diameter, or a flow passage which has an even flow passage diameter and in which a structure serving as a flow resistance is arranged, a flow passage which is curved, or a flow passage having a valve is cited.

In the following, the capillary tube nozzle is described in further detail. An inside diameter of the tip of the nozzle is preferably 0.01 μm or more, for manufacturing. Meanwhile, the upper limit of the inside diameter of the tip of the nozzle is preferably determined by an inside diameter of the tip of the nozzle when electrostatic force becomes larger than surface tension and an inside diameter of the tip of the nozzle when discharge conditions are satisfied by local electric field intensity. Furthermore, it is preferable that an amount of the droplet to be ejected is made smaller than that can be solidified and stacked on by evaporation, and the diameter of the nozzle is preferably adjusted according to the preferable amount of the droplet. Hence, although the inside diameter of the nozzle is affected by voltage to be applied and the kind of fluid to be used, according to general conditions, the nozzle has an inside diameter of, preferably, 15 μm or less, more preferably 10 μm or less. Furthermore, to more effectively use the effect of a focused electric field, it is particularly preferable that the inside diameter of the tip of the nozzle is from 0.01 μm to 8 μm.

Then, although an outside diameter of the tip of the nozzle is determined as appropriate in accordance with the inside diameter of the tip of the nozzle, the nozzle preferably has an outside diameter of the tip of 15 μm or less, more preferably 10 μm or less, and particularly preferably 8 μm or less. It is preferable that the nozzle is formed in the shape of a needle.

For example, when the nozzle 1 consists of glass having good formability, the nozzle cannot be used as an electrode. For this reason, a metal wire 2 (metal electrode wire) such as tungsten wire may be inserted into the nozzle 1 as an electrode, or an electrode may be formed in the nozzle by plating. When the nozzle 1 itself is formed by a conductive material, an insulator may be coated on the nozzle 1. The position where the electrode is arranged is not limited, and the electrode may be arranged inside or outside the nozzle, or inside and outside the nozzle, or at a position separate from the nozzle.

A solution 3 to be ejected can be filled in the nozzle 1. In this embodiment, when an electrode is inserted in the nozzle, the electrode 2 is arranged to be dipped in the solution 3. The solution (fluid) 3 is supplied from a solution source (not shown in figures). The nozzle 1 is fixed to a holder 6 by a shield rubber 4 and a nozzle clamp 5 such that pressure is prevented from leaking.

Pressure regulated by the pressure regulator 7 is transmitted to the nozzle 1 through a pressure tube 8.

The nozzle, the electrode, the solution, the shield rubber, the nozzle clamp, the holder, and the pressure holder are shown by a sectional side view, and a substrate 13 is arranged by a substrate support 14 (substrate holder) such that the substrate 13 is close to the tip of the nozzle.

The role of the pressure regulation device can be used to push a fluid out of the nozzle by applying high pressure to the nozzle. However, rather, the pressure regulating device is particularly effectively used to regulate a conductance, fill a solution in the nozzle, or eliminate clogging of the nozzle. Further, the pressure regulation device is effectively used to control the position of a liquid surface or form a meniscus. As another role of the pressure regulation device, the pressure regulation device gives a differed phase from a voltage pulse and a force acting on the liquid in the nozzle is controlled, thereby controlling a micro ejection rate.

An ejection signal from the computer 9 is transmitted to a prescribed waveform generation device 10 and controlled thereby.

A prescribed waveform voltage generated by the prescribed waveform generation device 10 is transmitted to the electrode 2 through a high-voltage amplifier 11. The solution 3 in the nozzle 1 is charged by the voltage. In this manner, the focused electric field intensity at the tip of the nozzle is increased.

In the case that a nozzle plate produced according to the production method of the present invention is used instead of the capillary tube nozzle, a fine inkjet capable of transferring a pattern in a batch can be made. The configuration of the electrodes and other parts can be made appropriate for the collective transferring, and thus it becomes possible to use this for the formation of three-dimensional structures, for example. In this manner, a great number of three-dimensional structures can be formed at one time when three-dimensional structures, for example, are formed, and the time for the formation can be drastically reduced. Furthermore, a thus obtained substrate where three-dimensional structures are provided can be used as a template for the formation of a nozzle plate having the same pattern. That is to say, it is possible to transfer and copy the three-dimensional structures (or the nozzle plate).

Nozzle plates produced according to the production method of the present invention are not limited to a fine inkjet shown in FIG. 2, and can be used for other inkjet systems.

Figure 3:
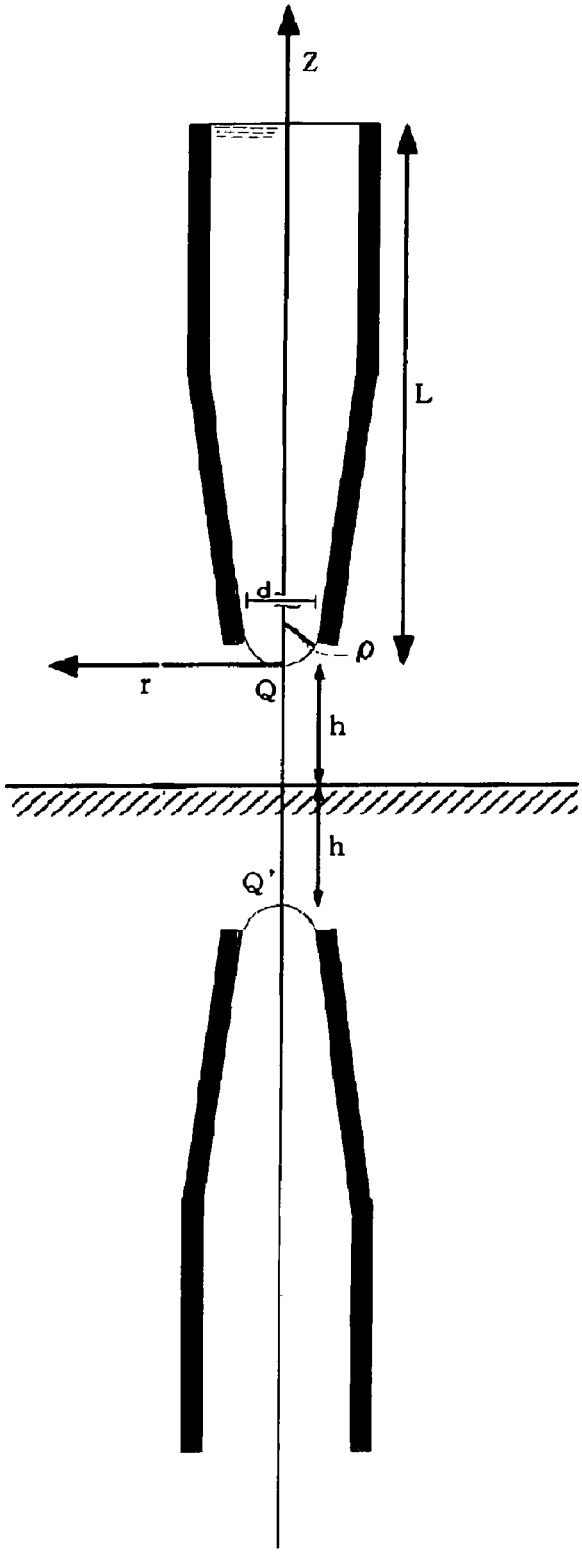
[FIG. 3] It is a schematic drawing for explaining calculation of an electric field intensity of a nozzle in the production method of the present invention.

In the fine inkjet, an electric field is focused on the tip portion of a nozzle, as shown in FIG. 3, so that the effects thereof cause a fluid droplet to be charged, and thus, the effects of the image force induced in the facing substrate are utilized. In this regard, FIG. 3 is a diagrammatical view schematically showing a state where a nozzle having an inside diameter d of the tip of the nozzle and filled with a conductive ink (fluid for droplet) is arranged vertically at a height of h from an endless plate-shaped conductive material. Then, r designates a direction parallel to the endless plate-shaped conductive material and Z designates a direction of Z axis (height). Furthermore, L and ρ designate the length of a flow passage and a radius of curvature, respectively. Q designates a charge induced at the tip of the nozzle and Q' designates an image charge induced at a symmetric position in the substrate and having an opposite charge. For this reason, it is not necessary to make a substrate 13 or a substrate supporting body 14 conductive or to apply voltage to the substrate 13 or the substrate supporting body 14 that is applied in conventional art. Moreover, voltage to be applied can be reduced by increasing electric field intensity focused on the tip of the nozzle. Furthermore, voltage applied to an electrode 2 may be plus or minus.

The distance between the nozzle 1 and the substrate 13 (hereinafter, unless otherwise specified, "the distance between the nozzle and the substrate" means the distance between the tip of the nozzle and the surface on the nozzle side of the substrate") can be adjusted as appropriate according to landing accuracy of the droplet given by an image force, or according to the amount of evaporation of the droplet during flight. That is, the distance between the nozzle and the substrate can be adjusted according to an increase in the viscosity of the droplet due to drying of the droplet during the flight. Then, the distance may be changed in accordance with the growth of the structure, and thereby it may be adjusted in such a way as to obtain that having higher aspect ratio. On the contrary, to avoid the influence of neighboring obtained structures close each other, the tip of the nozzle may be arranged at a position lower than the height of the structures. Meanwhile, in the case of ejecting the droplet on a concavo-convex surface of the substrate, a measure of distance is required to avoid the contact between the surface of the substrate and the tip of the nozzle. In consideration of landing accuracy of the droplet and the concavo-convex surface of the substrate, the nozzle 1 and the substrate 13 preferably have a distance of 500 μm or less. In the case where the concavo-convex of the surface of the substrate is little and a high degree of landing accuracy of the droplet is required, the nozzle 1 and the substrate 13 preferably have a distance of 100 μm or less, more preferably 50 μm or less. Meanwhile, to avoid the nozzle 1 from being too close to the substrate 13, the nozzle 1 and the substrate 13 preferably have a distance of 5 μm or more, more preferably 20 μm or more.

Although not shown in figures, feedback control performs for detecting a nozzle position to hold the nozzle 1 at a predetermined position with respect to the substrate 13. Further, the substrate 13 may be held such that the substrate 13 is placed on a conductive or insulating substrate holder.

According to the manufacturing method for a probe card of the present invention, the height of the three-dimensional structure can be controlled through the time for ejection, change in the voltage, the temperature of the substrate, the height of the nozzle and the like. Meanwhile, in terms of the thickness of the three-dimensional structure, it becomes easy to form the three-dimensional structures as the amount of ejection is reduced. At this time, a landed substance which has once started growing grows rapidly, and therefore it tends to become a thin and long structure. On the other hand, there are cases where it is desired for a thick structure to be formed or the diameter is desired to be changed, depending on the application. In such cases, it is possible to form a structure having any diameter by repeating the process of adjusting the voltage and the like so that the structure that has once grown is melted, and then making it grow again.

The fine inkjet apparatus used in the method of producing a collective transfer inkjet nozzle plate of the present invention can be compact, and there is high freedom in terms of its installation, and therefore it is possible to prepare multiple nozzles; for example, a fine inkjet apparatus as that described in WO03/070381 is appropriate for use. Here, the applied voltage may be either an alternating current voltage or a direct current voltage. In addition, the methods described in the specifications of Japanese Patent Application 2004-221937 and Japanese Patent Application 2004-221986 can also be used for the formation of three-dimensional structures. Here, it is desirable for the applied voltage to be a pulse voltage, an alternating current voltage or an alternating current voltage to which a direct current bias is applied, where the duty ratio is optimized, but the applied voltage may be a direct current voltage.

According to the method of producing a collective transfer inkjet nozzle plate of the present invention, though it is practical, in terms of adjustment of the position for forming structures, to place a substrate holder on an X-Y-Z stage so that the position of the substrate 13 can be changed, the method is not limited to this, and it is possible to instead place the nozzle 1 on the X-Y-Z stage. Further, an inter-nozzle-substrate distance can be regulated to an appropriate distance by using a fine position adjusting device. Moreover, in the position regulation of the nozzle, a Z-axis stage is moved by closed loop control on the basis of distance data obtained by a laser micrometer, and the nozzle position can be kept constant at an accuracy of 1 μm or less.

In a conventional raster scan scheme, at a step for forming a continuous line, circuit pattern may be disconnected due to a lack of landing position accuracy, defective ejection, or the like. For this reason, in this embodiment, in addition to the raster scan scheme, a vector scan scheme is employed. It is described in, e.g., S. B. Fuller et al., Journal of Microelectromechanical systems, Vol. 11, No. 1, p. 54 (2002) that circuit drawing is performed by vector scanning using a single-nozzle inkjet.

In raster scanning, new control software which was developed to interactively designate a drawing position on a computer screen may be used. In the case of vector scanning, when a vector data file is loaded, complex pattern drawing can be automatically performed. As the raster scan scheme, a scheme which is performed in a conventional printer can be properly used. As the vector scan scheme, a scheme used in a conventional plotter can be properly used.

For example, as a stage to be used, SGSP-20-35 (XY) available from SIGMA KOKI CO., LTD. and Mark-204 controller are used. As control software, software is self-produced by using Labview available from National Instruments Corporation. A case in which the moving speed of the stage is regulated within the range of 1 μm/sec to 1 mm/sec to obtain the most preferable drawing will be considered below. Here, in the case of the raster scanning, the stage is moved at a pitch of 1 μm to 100 μm, and ejection can be performed by a voltage pulse, linking with the movement of the stage. In the case of the vector scanning, the stage can be continuously moved on the basis of vector data.

In the method of producing a collective transfer inkjet nozzle plate of the present invention, these methods for adjusting the position of ejection can allow the position for forming three-dimensional structures to be adjusted freely and rapidly through setting and input of control data. Accordingly, the nozzle holes formed through shaping contours of three-dimensional structures can be arranged in accordance with the purpose and designed freely so that a nozzle plate which makes various types of printing possible can be provided. In addition, frequent changes in the printing pattern can be flexibly dealt with.

When the nozzle plate of the present invention having a high degree of freedom in the design as described above is used, it can be tailor made so that production in a small lot can be flexibly dealt with, making reduction in the length of time and cost possible.

Because the droplet discharged from a fine inkjet is fine, depending on the kind of solvent used for ink, the droplet evaporates instantly when the droplet lands on the substrate, thereby the droplet is instantaneously fixed at a landing position. In this condition, the drying speed of the droplet is order-of-magnitude larger than the drying speed of a droplet having a particle size of several tens μm produced by a conventional ink jet technology. This is caused by that the vapor pressure becomes significantly high due to the fineness of the droplets. Accordingly, a fine three-dimensional structure can be formed in a short period of time; preferably in 0.1 to 300 seconds (though this depends on the material, structure, size and the like), more preferably in 5 seconds to 120 seconds. In accordance with conventional inkjet technology using a piezo system or the like, it is difficult to form a three-dimensional structure so fine as that formed in the production method of the present invention, in a short period of time, in addition, the landing accuracy becomes poor.

Next, the substrate where three-dimensional structures are formed is used as a template, and nozzle holes are molded in a setting material (in the present invention, a setting material is defined as a material of which viscosity increases to such a degree that molding is possible under the conditions for molding, or a material which hardens appropriately). As the setting material, organic materials such as waxes, metal particulates pastes (such as Gold Nano Paste and Silver Nano Paste (trade mark of Harima Chemicals, Inc.)), sol-gel solutions of metal oxide materials (such as alumina) and resins (such as thermosetting resins and photosensitive-setting resins) can be cited as examples, and in particular, photosensitive-setting resins are preferable, and ultraviolet-ray hardening resins are more preferable. In addition, mixtures of these setting materials may be used. Other materials may be added, if necessary, as long as they do not diminish the performance of the nozzle plate when it is made (or to enhance the performance). Commercially available light hardening resins, for example, are also preferable for use.

The setting material can be applied to a template substrate through spin coating, dipping, spray coating, vapor deposition, sputtering and the like. Though the conditions for application are not particularly limited, methods according to which the three-dimensional structures are not damaged are preferable.

The thickness of the applied setting material can be determined in accordance with the thickness of the nozzle plate to be obtained, and 1 μm to 1,000 μm is preferable, and 10 μm to 100 μm is more preferable. The area to which the material is applied is not particularly limited, and this can be the same as the area of the substrate.

According to the production method for a collective transfer inkjet nozzle plate of the present invention, the setting material is hardened after application so that the form molded from the three-dimensional structures is settled, and thus a nozzle shape is obtained. Though the method for hardening is not particularly limited, an appropriate method, such as heating, drying, irradiation with light or addition of a hardening agent, can be selected depending on the properties of the setting material. In the case of an ultraviolet-ray curing resin, for example, it is preferable to irradiate with ultraviolet rays having a wavelength of 330 nm to 390 nm, and it is preferable for the time for irradiation to be approximately 30 seconds to 3 minutes depending on the amount and the like of the material. Ultraviolet rays may be irradiated from an ordinary apparatus, such as high pressure mercury lamps and ultraviolet ray emitting diodes.

Furthermore, the material after hardening (hereinafter, also referred to hardened setting material) is removed from the template substrate so that a nozzle plate can be obtained. At this time, it is not necessary for the hardening reaction to completely finish, and in some cases, mold releasing properties are rather better in a semi-hardened state. In the present invention, the material that hardens after hardening includes such a pseudo-hardened state. Though a flat substrate is cited as an example of the substrate for the description, three-dimensional structures may be formed on a roll.

Furthermore, it is preferable to coat the surface of the removed nozzle plate for the purpose of enhancing the resistance to corrosion and the strength. As a preferable coating method, coating with a fluorine resin, hydrocarbon coating and electroless plating can be cited as examples.

The nozzle holes of a collective transfer inkjet nozzle plate obtained according to the production method of the present invention are formed through shaping three-dimensional structures, and therefore the shape and the arrangement of the nozzle holes become approximately the same as the contour and the arrangement of the three-dimensional structures. Accordingly, the nozzle holes can have any shape, if the shape is molded from which the three-dimensional structures can be pulled out. In addition, it is not necessary for the nozzle holes to be penetrating holes at the time of molding, and in the case where they are not penetrating holes, the surface portion of the nozzle plate can be sliced off using a dicing saw or a microtome, or can be shaved off through reactive ion etching, sputtering, mechanical polishing, chemical polishing, mechanical processing or the like so that penetrating holes can be formed. In addition, it is preferable for the depth of the nozzle holes to be 10 μm to 100 mm, taking into consideration the usage of the nozzle in addition to the height of the three-dimensional structures, and it is more preferable for it to be 50 μm to 10 mm, and it is particularly preferable for it to be 100 μm to 1 mm.

A nozzle plate obtained according to the production method of the present invention can be mounted on an inkjet apparatus so that a collective transfer inkjet apparatus can be provided. In addition, nozzle holes in required form can be rapidly and easily provided in required locations by entering the data into a computer (via molding from three-dimensional structures), and thus, the transfer of various patterns, such as printing onto electronic parts, can be dealt with. In addition, fine holes with a small pitch can be formed to such a degree as to exceed those which are possible using conventional hole creating technologies, and thus, the demands of miniaturization in terms of the size and the interval of printing dots can be met. In addition, etching is not used for the creation of fine holes, and therefore, the nozzle plate is excellent in terms of the freedom for the selection of the materials used, the process using no masks and the potential for it to have a high aspect. In addition, there are no other problems, such as burrs, inconsistent exposure to light, inconsistency in processing or poor resolution for processing, which tend to arise in laser processing, technology for light exposure and discharge processing, and thus, an excellent nozzle plate can be formed.

Furthermore, it is also possible as a preferred embodiment that a number of nozzle plates having different patterns of nozzle holes are combined so that a wide ranging pattern can be transferred collectively. At this time, it is also possible to change combinations by exchanging the number of plates so that patterns having more variations can be drawn.

A collective transfer inkjet nozzle plate produced according to the production method of the present invention can be used in various fields such as, for example, substrate formation, three-dimensional structure formation, joining of targeted objects, filling of targeted holes and inkjet patterning technologies.

EXAMPLES

The present invention will be described in more detail based on examples below, but the present invention is not limited by these.

Reference Example 1

A silver particulate paste (Silver Nano Paste, made by Harima Chemicals, Inc., silver content: 58 mass %, specific weight: 1.72, viscosity: 8.4 cps) was ejected on a silicon substrate through inkjet as shown in FIG. 2, and thus three-dimensional structures were formed. Here, the inner diameter at the tip of the nozzle was 1 μm, under an atmosphere of 22° C., the voltage applied to the paste within the nozzle as the peak-to-peak voltage in the alternating current voltage was 350 V, and the distance between the nozzle and the substrate was set to approximately 100 μm, respectively. The time required to form one three-dimensional structure was 20 seconds. The cross-sectional diameter of the three-dimensional structure was approximately 6 μm, the height was approximately 30 μm.

Figure 4:
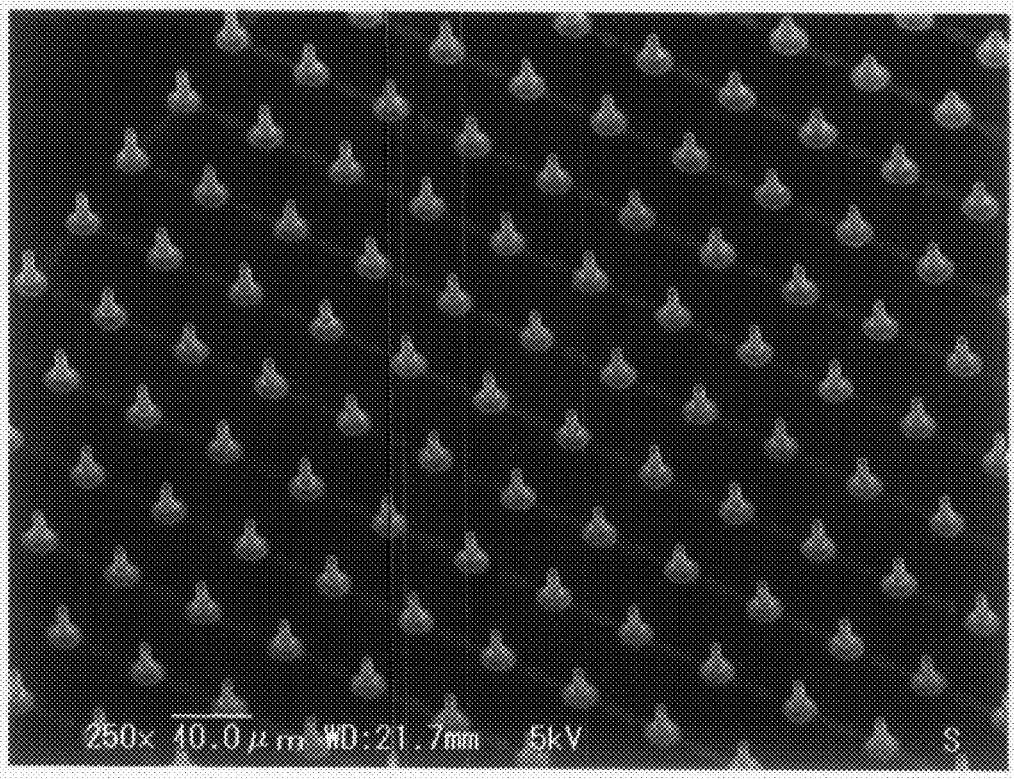
[FIG. 4] It is a microscope photograph (magnification: 250 times), instead of a drawing, showing a template with three-dimensional structures obtained in Reference Example 1.
Figure 5:
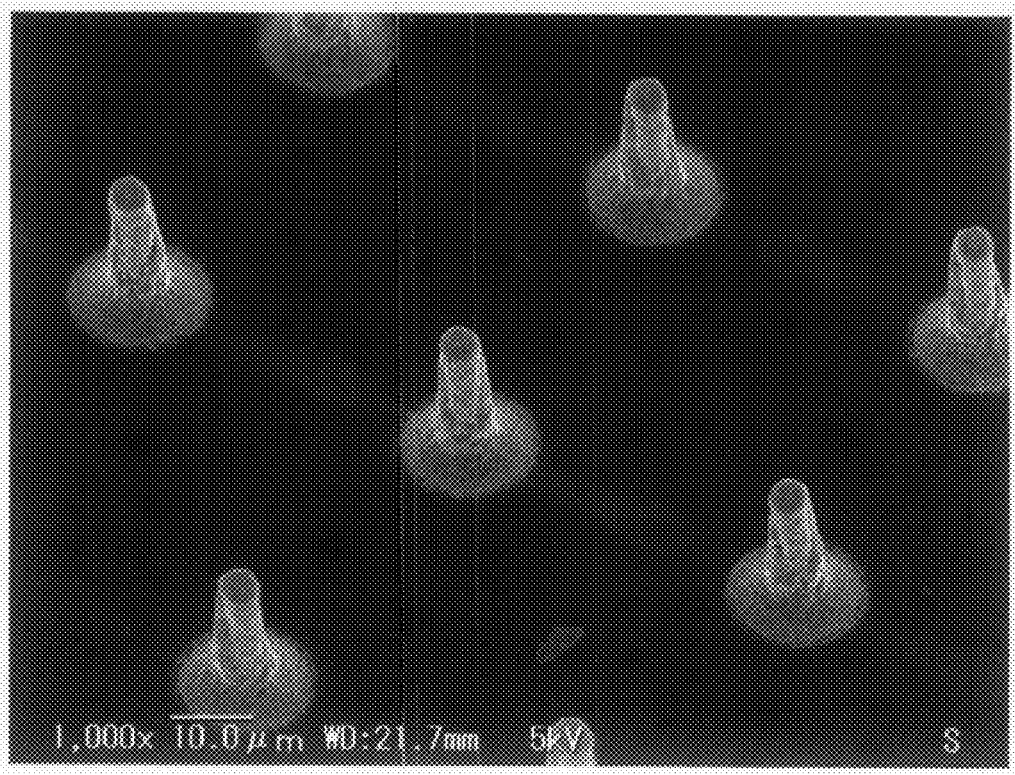
[FIG. 5] It is a microscope photograph (magnification: 1,000 times), instead of a drawing, showing a template with three-dimensional structures gained in Reference Example 1.

According to the above described method, three-dimensional structures were formed while moving the nozzle at a pitch of 50 μm so that the three-dimensional structures were arranged at equal intervals, and thus, a template for molding was fabricated. FIG. 4 was a microscope photograph (magnification: 250 times) showing the thus formed three-dimensional structures. FIG. 5 was a further enlarged microscope photograph (magnification: 1,000 times) showing these three-dimensional structures.

Reference Example 2

Figure 6:
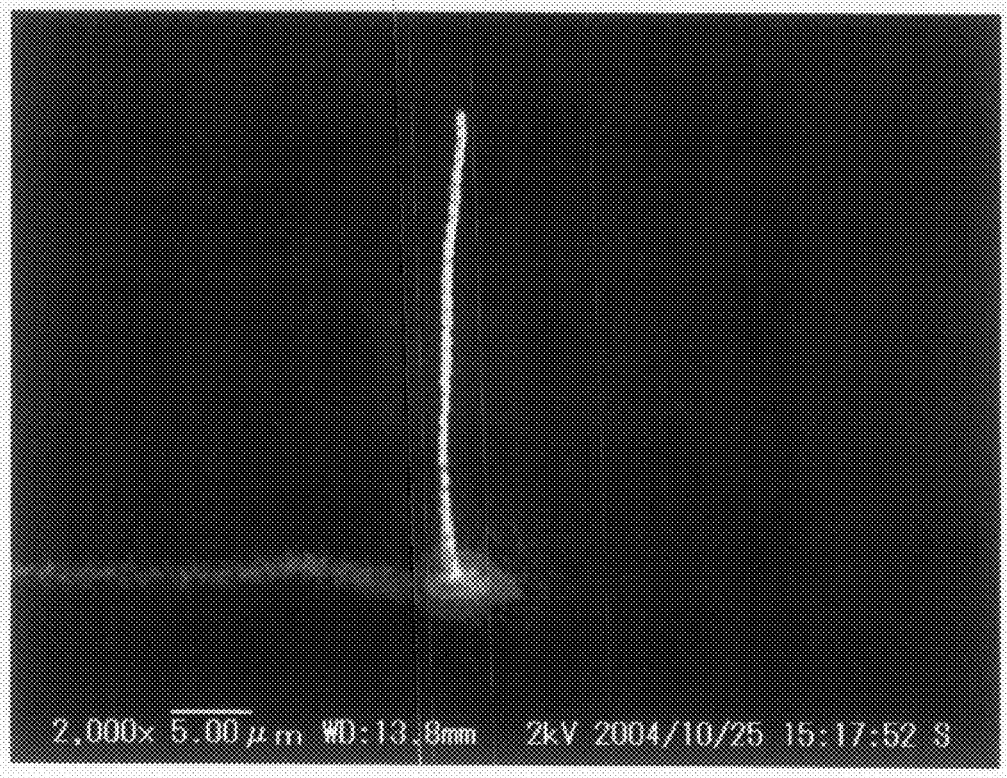
[FIG. 6] It is a microscope photograph (magnification: 2,000 times), instead of a drawing, showing a template with three-dimensional structures gained in Reference Example 2.

Three-dimensional structures were formed in the same manner as in the method described in Reference Example 1, except that the time for forming the three-dimensional structures was set to 15 sec and the applied voltage was set lower, and thus, a template for molding was fabricated. The cross-sectional diameter of the three-dimensional structures formed on the template was approximately 0.6 μm, and the height was 40 μm. FIG. 6 is a microscope photograph (magnification: 2,000 times) of the thus formed three-dimensional structures.

Example 1

Figure 7:
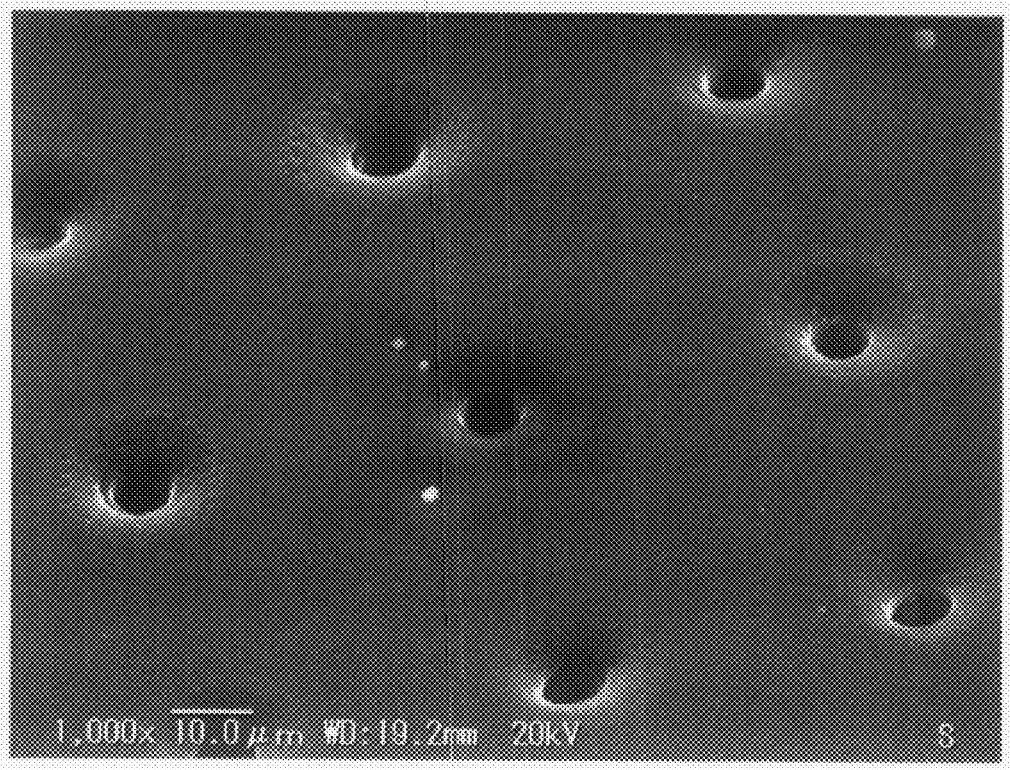
[FIG. 7] It is a microscope photograph (magnification: 1,000 times), instead of a drawing, showing a resin substrate (nozzle plate), in which fine holes are formed, obtained in Example 1.
Figure 8:
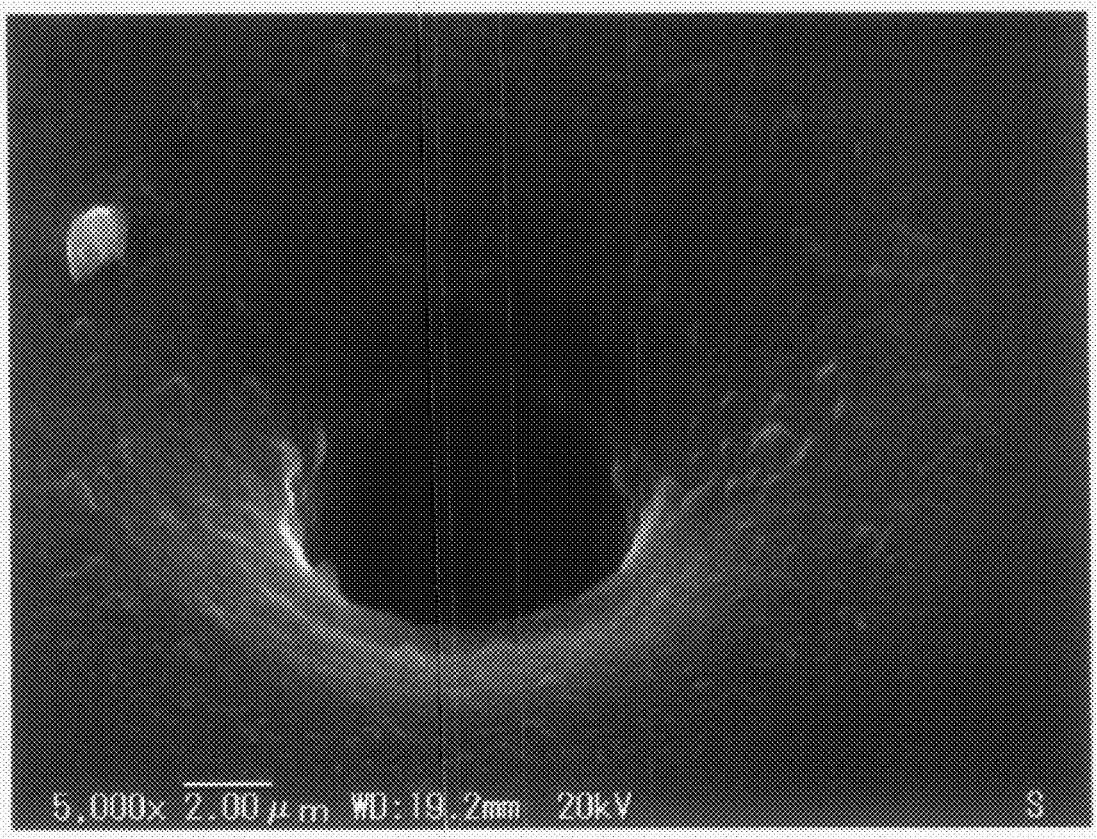
[FIG. 8] It is a microscope photograph (magnification: 5,000 times), instead of a drawing, showing a resin substrate (nozzle plate), in which fine holes are formed, obtained in Example 1.

An ultraviolet-ray hardening resin (product number: 3014C, made by ThreeBond Co., Ltd.) was cast to a thickness of approximately 1 mm on the template fabricated in Reference Example 1, and the resin was hardened through irradiation with an ultraviolet ray having a wavelength of 380 nm for 1 minute. The irradiation with ultraviolet rays was carried out using an ultraviolet ray radiating apparatus, UV-300, made by Keyence Corporation. The resin after hardening was peeled off from the substrate, and thus, a resin substrate where a great number of fine holes were provided was formed. The opening diameter of the fine holes was approximately 6 μm, and the pitch of the fine holes was 50 μm. FIG. 7 was a microscope photograph (magnification: 1,000 times) showing the resin substrate where fine holes were provided. In addition, FIG. 8 was a further enlarged microscope photograph (magnification: 5,000 times) showing one fine hole.

It can be comprehended from the results that a nozzle plate with fine holes formed in a required alignment can be produced according to the production method of the present invention.

INDUSTRIAL APPLICABILITY

A collective transfer inkjet nozzle plate produced according to the production method of the present invention can be used in various fields such as, for example, substrate formation, three-dimensional structure formation, joining of targeted objects, filling of targeted holes, and inkjet patterning technologies.

The invention claimed is:

1. A method of producing a collective transfer inkjet nozzle plate, comprising:

forming three-dimensional structures arranged on a substrate in accordance with a fine inkjet process according to data in a computer, coating a setting material in a portion of the substrate other than portions where the three-dimensional structures are formed, then hardening the setting material, and then removing a plate of the hardened setting material to form fine nozzle holes therein.

2. The method of producing a collective transfer inkjet nozzle plate according to claim 1, wherein the setting material is a metal material, a metal oxide material, a resin, or a mixed material thereof.

3. The method of producing a collective transfer inkjet nozzle plate according to claim 1 or 2, wherein the setting material is an ultraviolet-ray hardening resin.

4. The method of producing a collective transfer inkjet nozzle plate according to claim 1, wherein an inner diameter of the fine nozzle holes is in a range of from 0.1 μm to 100 μm.

5. The method of producing a collective transfer inkjet nozzle plate according to claim 1, wherein the fine nozzle holes are aligned in a prescribed pattern by setting the data in the computer.

6. The method of producing a collective transfer inkjet nozzle plate according to claim 1, wherein the fine inkjet process comprises, to form the three-dimensional structures: flying and landing fine droplets onto the substrate by a focused electric field, and drying and solidifying the fine droplets to be stacked up.

7. A collective transfer inkjet nozzle plate, comprising:

a base plate made of a setting material;

plural fine nozzle holes formed in the base plate, the holes located in an arbitrary interval, the holes having an inner diameter of the range of from 0.1 μm to 100 μm;

wherein the fine nozzle holes in the base plate molded and set by contours of three-dimensional structures consisting of a material having conductivity of $10^{-5}$ S/m or more, in which the three-dimensional structures are formed on a substrate in accordance with a fine inkjet process, and wherein the fine inkjet process comprises, to form the three-dimensional structures: flying and landing fine droplets onto the substrate by a focused electric field, and drying and solidifying the fine droplets to be stacked up.

8. The collective transfer inkjet nozzle plate according to claim 7, wherein the interval between the nozzle holes is 50 μm or less.

9. The collective transfer inkjet nozzle plate according to claim 7, wherein the nozzle holes have a depth of 10 μm to 10 mm.

10. The collective transfer inkjet nozzle plate according to claim 7, wherein the base plate comprises photosensitive-setting resins.

11. The collective transfer inkjet nozzle plate according to claim 7, wherein the inner diameter of the nozzle holes is 20 μm or less.

12. The collective transfer inkjet nozzle plate according to claim 7, wherein the nozzle holes have an aspect ratio of 1 or more.

13. A collective transfer inkjet comprising the collective transfer inkjet nozzle plate according to claim 7.

14. A collective transfer inkjet nozzle plate, comprising:

a base plate made of a setting material on a substrate;

a plurality of fine nozzle holes formed in the base plate, the holes located at arbitrary intervals, the holes having an inner diameter in a range of from 0.1 μm to 100 μm; and three-dimensional structures formed on the substrate by a fine inkjet process, wherein the plurality of fine nozzle holes are molded and set by contours of the three-dimensional structures and comprise a material having a conductivity of $10^{-5}$ S/m or more, and wherein the fine inkjet process comprises flying and landing fine droplets onto the substrate by a focused electric field, and drying and solidifying the fine droplets so as to form the three-dimensional structures.

* * * * *